US006947687B2

(12) United States Patent
Yamaguchi et al.

(10) Patent No.: US 6,947,687 B2
(45) Date of Patent: Sep. 20, 2005

(54) CARTRIDGE HAVING LOCKING PORTION FOR LOCKING CARTRIDGE WITH AN IMAGE FORMING APPARATUS AND RELEASING PORTION TO RELEASE THE LOCKING PORTION, AND IMAGE FORMING APPARATUS HAVING SUCH A CARTRIDGE

(75) Inventors: Koji Yamaguchi, Numazu (JP); Tatsuya Shiratori, Yokohama (JP); Kazuhiko Kanno, Odawara (JP)

(73) Assignee: Canon Kabushiki Kaisha, Tokyo (JP)

( * ) Notice: Subject to any disclaimer, the term of this patent is extended or adjusted under 35 U.S.C. 154(b) by 92 days.

(21) Appl. No.: 10/453,811

(22) Filed: Jun. 4, 2003

(65) Prior Publication Data

US 2004/0037587 A1 Feb. 26, 2004

(30) Foreign Application Priority Data

Jun. 7, 2002 (JP) ..... 2002-167000

(51) Int. Cl.[7] ..... G03G 21/16
(52) U.S. Cl. ..... 399/111; 399/227; 399/112
(58) Field of Search ..... 399/110, 111, 399/119, 223, 225, 226, 227, 112

(56) References Cited

U.S. PATENT DOCUMENTS

| | | | | |
|---|---|---|---|---|
| 4,743,938 A | | 5/1988 | Ohno | 355/3 |
| 5,066,976 A | | 11/1991 | Kanagawa et al. | 355/200 |
| 5,418,601 A | | 5/1995 | Fujisawa et al. | 355/200 |
| 5,729,796 A | | 3/1998 | Miura et al. | 399/114 |
| 5,768,658 A | | 6/1998 | Watanabe et al. | 399/111 |
| 5,794,103 A | | 8/1998 | Oh | 399/119 |
| 5,815,644 A | | 9/1998 | Nishiuwatoko et al. | 399/113 |
| 5,870,655 A | | 2/1999 | Nishiuwatoko et al. | 399/111 |
| 5,893,006 A | | 4/1999 | Kanno et al. | 399/13 |
| 5,926,666 A | | 7/1999 | Miura et al. | 399/25 |
| 5,937,240 A | | 8/1999 | Kanno et al. | 399/111 |
| 5,940,657 A | | 8/1999 | Yokomori et al. | 399/119 |
| 5,950,049 A | | 9/1999 | Yokomori et al. | 399/119 |
| 6,070,029 A | | 5/2000 | Nishiuwatoko et al. | 399/111 |
| 6,072,969 A | * | 6/2000 | Yokomori et al. | 399/119 |
| 6,101,350 A | * | 8/2000 | Suzuki et al. | 399/113 |
| 6,104,895 A | | 8/2000 | Yokomori et al. | 399/113 |

(Continued)

FOREIGN PATENT DOCUMENTS

| | | | | |
|---|---|---|---|---|
| EP | 1 308 794 | | 5/2003 | |
| JP | 62-127850 | | 6/1987 | |
| JP | 3-116323 A | | 12/1991 | |
| JP | 7-295381 | | 11/1995 | |
| JP | 07295381 A | * | 11/1995 | G03G/15/08 |
| JP | 8-328448 | | 12/1996 | |
| JP | 09329964 A | * | 12/1997 | G03G/15/08 |
| JP | 11-73018 A | | 3/1999 | |
| JP | 2001175077 A | * | 6/2001 | G03G/15/08 |

*Primary Examiner*—Robert Beatty
(74) *Attorney, Agent, or Firm*—Fitzpatrick, Cella, Harper & Scinto

(57) ABSTRACT

A cartridge detachably mountable to a main assembly of an electrophotographic image forming apparatus, includes a developing member for developing an electrostatic latent image formed on an electrophotografic photosensitive member, a developer accommodating portion for accommodating a developer to be used for developing an electrostatic latent image by the developing member, a cartridge locking portion for locking the cartridge with a main assembly locking portion provided in the main assembly of the apparatus to prevent the cartridge from disengaging from the main assembly of the apparatus when the cartridge is mounted to the main assembly of the apparatus, and a relasing member for releasing the cartridge locking portion to release the cartridge from the main assembly locking portion when the cartridge is to be removed from the main assembly of the apparatus.

12 Claims, 11 Drawing Sheets

U.S. PATENT DOCUMENTS 6,104,898 A * 8/2000 Awano et al. ..... 399/119
6,141,508 A 10/2000 Sasaki et al. ..... 399/27
6,345,164 B1 2/2002 Yokomori et al. ..... 399/119
6,381,430 B1 4/2002 Yokomori et al. ..... 399/119
6,496,667 B2 12/2002 Shiratori et al. ..... 399/103
6,516,168 B2 2/2003 Shiratori et al. ..... 399/103
6,535,705 B2 * 3/2003 Asakura et al. ..... 399/119
6,560,422 B2 5/2003 Kanno et al. ..... 399/106
6,650,855 B1 * 11/2003 Tajima ..... 399/227
2002/0110386 A1 8/2002 Kanno et al. ..... 399/111
2003/0086723 A1 5/2003 Yamaguchi et al. ..... 399/119

* cited by examiner

CARTRIDGE HAVING LOCKING PORTION FOR LOCKING CARTRIDGE WITH AN IMAGE FORMING APPARATUS AND RELEASING PORTION TO RELEASE THE LOCKING PORTION, AND IMAGE FORMING APPARATUS HAVING SUCH A CARTRIDGE

FIELD OF THE INVENTION AND RELATED ART

The present invention relates to a cartridge, and an electrophotographic image forming apparatus employing a cartridge.

An electrophotographic image forming apparatus refers to an apparatus for forming an image on recording medium (for example, recording paper, OHP sheet, etc.) using an electrophotographic image forming method. It includes electrophotographic copying machines, electrophotographic printers (laser printers, LED printers, etc.), facsimile machines, word processors, etc., for example.

Some electrophotographic image forming apparatuses employ a cartridge system, according to which a combination of, for example, a developing member and a developer storing portion is integrally disposed in a cartridge removably mountable in the main assembly of an image forming apparatus. A cartridge system makes it easy to maintain the developing member as one of the processing means, therefore making it possible for a user to maintain the developing member by him or herself. Thus, a cartridge system has come to be widely used in the field of an electrophotographic image forming apparatus.

A rotary device is disposed in the main assembly of an electrophotographic color image forming apparatus. The rotary has been known to be structured so that a plurality of (for example, four) process cartridges containing developers, one for one, different in color can be removably mountable in the rotary device.

As for the means for preventing a development cartridge from dislodging from a rotary device when the rotary device rotates, various structures have been invented. The following is one of the widely known structures.

According to this structure, a development cartridge is provided with a pair of projections, which project from the lateral end plates of the development cartridge, one for one, and when the development cartridge is mounted in the main assembly of an image forming apparatus, these projections engage a pair of guides provided in the lateral end plates of the rotary device of an image forming apparatus, guiding thereby the development cartridge as the development cartridge is inserted into the rotary device. Further, the end portion of each guide on the rotary device side is provided with a spring, which is capable of clasping the above-described projection of the development cartridge in order to hold the cartridge in the rotary device, by the force the resiliency of this spring generates. Thus, the spring must be strong enough to prevent the cartridge from being dislodged by the centrifugal force generated by the rotation of the rotary device. However, making the spring strong enough to prevent the cartridge from being dislodged by the centrifugal force increases the force required to mount the cartridge into the rotary device or dismount the cartridge therefrom. Further, there is a possibility that when mounting or dismounting the cartridge, one of the projections (left and right projections) will become disengaged from the spring ahead of the other. If one of the projections becomes disengaged from the spring ahead of the other, the cartridge may become tilted and hang up in the rotary device. On the other hand, making the spring weaker to moderate the force necessary to mount or dismount the cartridge may allow the cartridge to dislodge from the rotary device, and the dislodgment of the cartridge from the rotary device may result in damage to the main assembly of an image forming apparatus. Thus, the resiliency of the spring must be set high enough to prevent the cartridge from dislodging.

SUMMARY OF THE INVENTION

The primary object of the present invention is to provide a combination of a cartridge and an electrophotographic image forming apparatus, which is superior in the reliability and efficiency with which the cartridge is mounted into, or dismounted from, the main assembly of the image forming apparatus.

Another object of the present invention is to provide a combination of a cartridge and an electrophotographic image forming apparatus, which prevents the cartridge from accidentally dislodging from the main assembly of the image forming apparatus after the mounting of the cartridge into the main assembly.

Another object of the present invention is to provide a combination of a cartridge and an electrophotographic image forming apparatus, which assures that the cartridge is kept accurately disposed in the predetermined position in the main assembly of the image forming apparatus.

Another object of the present invention is to provide a combination of a cartridge and an electrophotographic image forming apparatus, in which the cartridge in the rotary device of the main assembly of the image forming apparatus is prevented from being accidentally dislodged by the rotation of the rotary device.

Another object of the present invention is to provide a combination of a cartridge and an electrophotographic image forming apparatus, in which as an operator releases his or her hand from the handle portion of the cartridge which the operator is holding in order to mount the cartridge into the main assembly of the image forming apparatus, the cartridge locking portions of the cartridge engaging with the cartridge locking portions of the main assembly.

Another object of the present invention is to provide a combination of a cartridge and an electrophotographic image forming apparatus, in which as an operator grasps the handle portion of the cartridge in order to dismount the cartridge from the main assembly of the image forming apparatus, the cartridge locking portions of the cartridge disengaging from the cartridge locking portions of the main assembly.

Another object of the present invention is to provide a combination of a cartridge and an electrophotographic image forming apparatus, in which the cartridge can be instinctively and easily mounted into, or removed from, the main assembly of the image forming apparatus by an operator.

Another object of the present invention is to provide a combination of an electrophotographic image forming apparatus and a cartridge removably mountable in the electrophotographic image forming apparatus, in which the cartridge includes: a developing member for developing an electrophotographic latent image formed on an electrophotographic photoconductive member; a developer storage portion for holding the developer used for developing the developing member by the developing member; cartridge locking portions which engage with the cartridge locking portions of the main assembly of the image forming apparatus to prevent the cartridge from becoming dislodged from the main assembly of the image forming apparatus, after the proper mounting of the cartridge into the rotary unit of the main assembly of the electrophotographic image forming apparatus; and cartridge unlocking portions for disengaging the cartridge locking portions of the cartridge from the cartridge locking portions of the main assembly of the image forming apparatus, when removing the cartridge from the main assembly of the image forming apparatus.

These and other objects, features, and advantages of the present invention will become more apparent upon consideration of the following description of the preferred embodiments of the present invention, taken in conjunction with the accompanying drawings.

DESCRIPTION OF THE PREFERRED EMBODIMENTS

Hereinafter, a development cartridge, as an example of a cartridge, in accordance with the present invention will be described.

Each of the development cartridges in the following embodiments of the present invention is a cartridge in which a developing member and a developer storage portion are integrally disposed.

(Embodiment 1)

Next, the first embodiment of the combination of a development cartridge and an electrophotographic image forming apparatus, in accordance with the present invention, will be described with reference to the appended drawings. In the following description of the embodiments of the present invention, the front side denotes the upstream side in terms of the direction in which recording medium is conveyed from the transfer station to the fixing station (right side in FIG. 1). The left and right sides of the main assembly of the image forming apparatus, and the cartridge, denote the left and right sides as seen from the front side of the main assembly of the image forming apparatus. The lengthwise direction denotes the direction which is parallel to the surface of the recording medium, and which intersects with (virtually perpendicular to) the direction in which the recording medium is conveyed.

Structure of Image Forming Apparatus)

Figure 1:
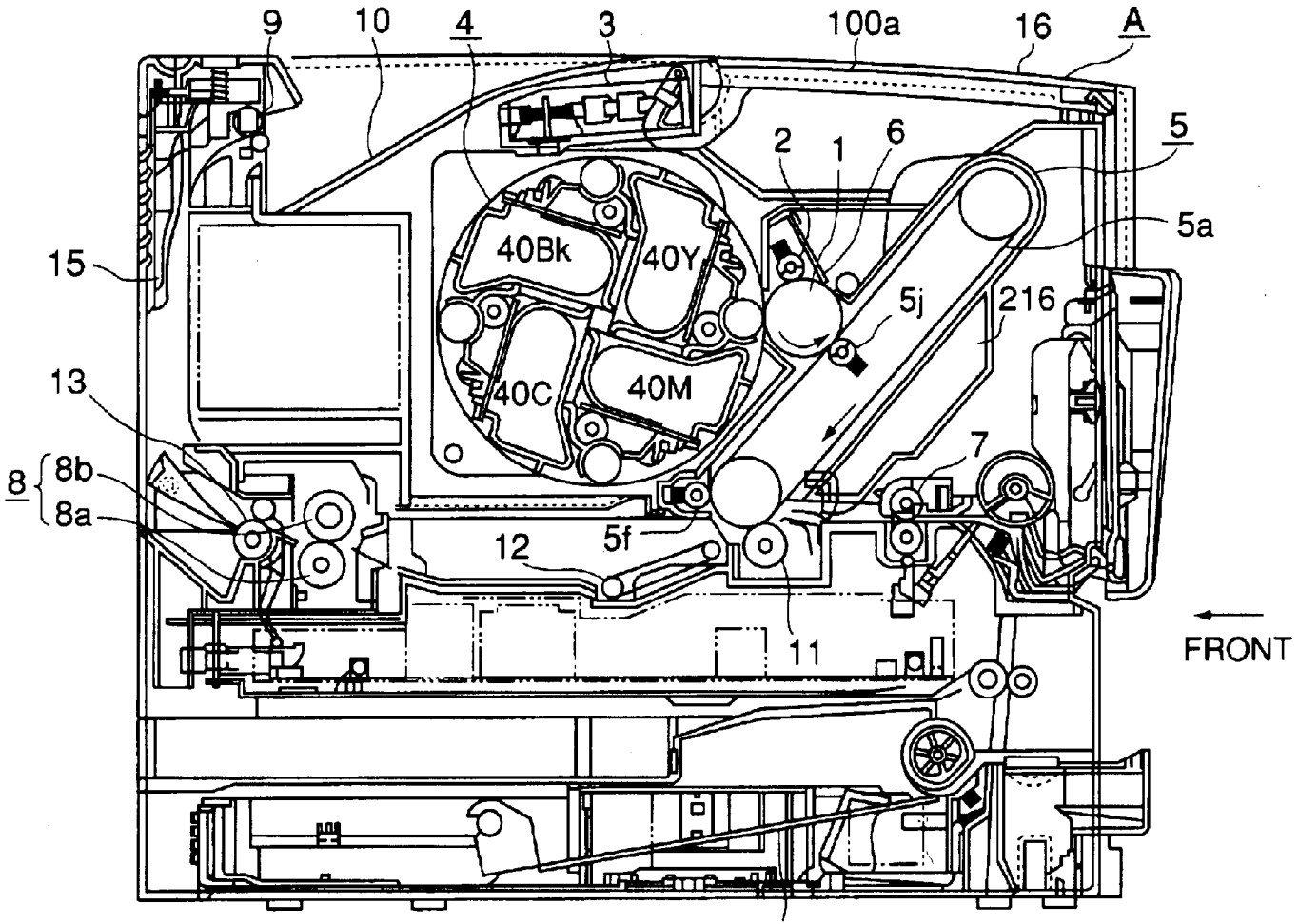
FIG. 1 is a schematic drawing showing the general structure of an example of the image forming apparatus in accordance with the present invention.

First, referring to FIG. 1, the general structure of the electrophotographic image forming apparatus will be described. FIG. 1 is a schematic drawing showing the general structure of the image forming apparatus 100 in this embodiment of the present invention.

The image forming apparatus 100 in FIG. 1 is a color laser beam printer, as an example of an image forming apparatus that includes the main assembly 10*a* in which a development cartridge, a process cartridge, and an intermediary transfer unit are disposed.

The image forming operation of the image forming apparatus in FIG. 1 is as follows. That is, an optical image reflecting given image formation information is projected from an exposing unit 3 onto an electrophotographic photoconductive member (which hereinafter will be referred to as a photoconductive drum 1) in the form of a drum, forming an electrophotographic latent image thereon. Then, the electrostatic latent image on the photoconductive drum 1 is developed by a developing member 305 (which hereinafter will be referred to as development roller 305), into an image formed of developer (which hereinafter will be referred to as developer image or toner image). In synchronism with the formation of this developer image on the photoconductive drum 1, a recording medium P is conveyed by a conveying means. Meanwhile, the developer image on the photoconductive drum 1 is transferred onto an intermediary transfer belt 5*a*. Then, the developer image on the intermediary transfer belt 5*a* is transferred onto the recording medium P by a second transferring unit. Thereafter, the recording medium P is conveyed to a fixing device 8 including a pressure roller 8*a* and heat roller 8*b*. In the fixing device 8, the developer image on the recording medium P is permanently fixed to the recording medium P. Then, the recording medium P is discharged onto a delivery tray 10 by a pair of discharge rollers 9.

The recording medium P is recording paper, OHP sheet, etc., for example. The developing member does not need to be in the form of a roller (development roller). For example, it may be in the form of a belt.

Next, the image formation process will be described in more detail.

The photoconductive drum 1 is rotated in the direction (counterclockwise direction) indicated by an arrow mark in FIG. 1, in synchronism with the rotation of the transfer belt 5*a*. As it is rotated, the peripheral surface of the photoconductive drum 1 is uniformly charged by a charge roller 2. Then, an optical image corresponding to, for example, the yellow component of an intended image, is projected by the exposing unit 3, onto the uniformly charged peripheral surface of the photoconductive drum 1, forming an electrostatic latent image corresponding to the yellow component of the intended image, on the peripheral surface of the photoconductive drum 1.

More specifically, the exposing unit 3 carries out the following steps. That is, the exposing unit 3 projects onto the photoconductive drum 1, an optical image reflecting the image formation information read through an external apparatus or the like. The exposing unit 3 has a laser diode, a polygon mirror, a scanner motor, a focusing lens, and a deflection mirror.

As image signals are sent from the external apparatus or the like, the laser diode emits a beam of laser light, in accordance with the signals. The emitted laser beam is projected, as an image formation beam, onto the polygon mirror, which is being rotated at a high velocity by a motor. Thus, the image formation beam is deflected by the rotating polygon mirror. After being deflected by the rotating polygon mirror, the image formation beam travels through the focusing lens, is deflected by the deflection mirror, and selectively exposes numerous points on the peripheral surface of the photoconductive drum 1. As a result, an electrostatic latent image is formed on the peripheral surface of the photoconductive drum 1. While the electrostatic latent image is formed, a rotary device 4 is rotated, moving the development cartridge 40Y for developing the electrostatic latent image into a yellow developer image, into the development position. Then, a predetermined bias voltage is applied to the cartridge 40Y to develop (i.e., adhere yellow toner to) the electrostatic latent image. Thereafter, a bias voltage, which is opposite in polarity to the toner, is applied to the primary transfer roller 5*j* of the transfer belt 5*a*. As a result, the yellow toner image on the photoconductive drum 1 is transferred onto the transfer belt 5*a* (primary transfer).

After the completion of the above-described process (primary transfer) of transferring the yellow toner image, the rotary device 4 is rotated again to move the next cartridge 40 into the development position in which this cartridge 40 will oppose the photoconductive drum 1. The sequence of the above-described steps is repeated to form magenta, cyan, and black developer images, one for one. Consequently, four developer images different in color are layered on the transfer belt 5*a*. During the above-described period in which the developer images are formed, the secondary transfer roller 11 is kept in a position in which it does not contact the transfer belt 5*a*, and also, the cleaning-charging roller 5*f* as a cleaning unit is kept in a position in which it does not contact the transfer belt 5*a*.

The magenta development cartridge 40M has a development roller 305, and a developer storage portion 302 in which magenta developer is stored. Similarly, the cyan development cartridge 40C has a development roller 305 (FIG. 7), and a developer storage portion 302 (FIG. 7) in which cyan developer is stored. The yellow development cartridge 40Y has a development roller 305, and a developer storage portion 302 in which yellow developer is stored. The black development cartridge 40B has a development roller 305, and a developer storage portion 302 in which black developer is stored.

After the formation of the four developer images different in color on the transfer belt 5*a*, the transfer roller 11 is pressed upon the transfer belt 5*a* as shown in FIG. 1. Further, at the same time as the transfer roller 11 is pressed upon the transfer belt 5*a*, the recording medium P, which has been kept on standby by a pair of registration rollers 7, is released to be sent to the recording medium nipping portion formed between the transfer belt 5*a* and transfer roller 11 by the transfer belt 5*a* and transfer roller 11. The transfer roller 11 is supplied with bias voltage opposite in polarity to the developer. As a result the developer images on the transfer belt 5*a* are transferred all at once onto the surface of the recording medium P being conveyed through the nipping portion (secondary transfer). After the secondary transfer of the toner images, the recording medium P is conveyed to the fixing device 8 by way of a conveyance belt unit 12. In the fixing device 8, the toner images are fixed to the recording medium P. Thereafter, the recording medium P is conveyed along the guide 15 by a pair of rollers 13. Then, the recording medium P is discharged into the delivery tray 10.

Figure 8:
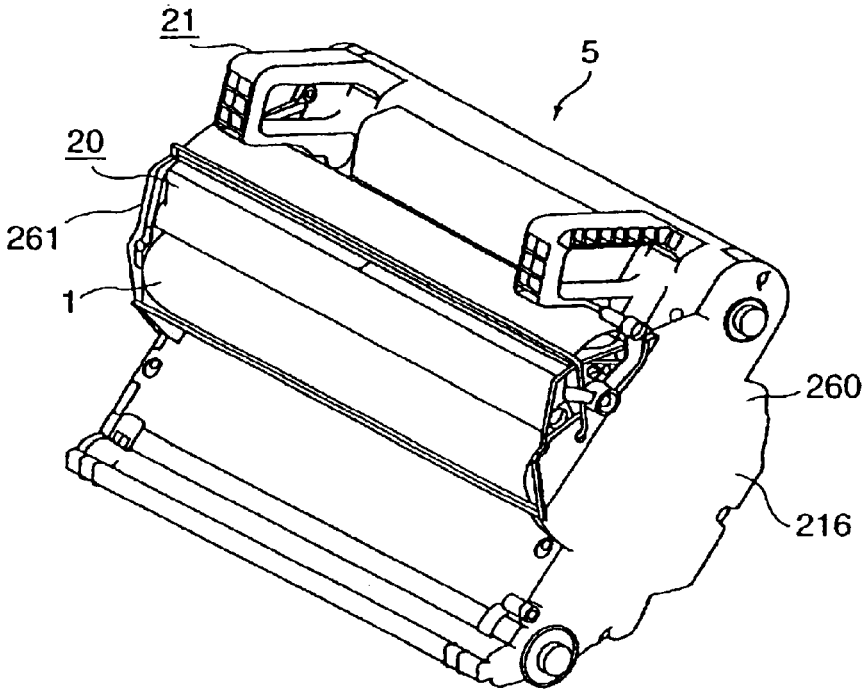
FIG. 8 is a perspective view of the process cartridge, as seen from diagonally above the left side thereof.

Meanwhile, the cleaning-charging roller 5*f* is pressed upon the transfer belt 5*a* after the secondary transfer. Then, the electric charge of the surface of the transfer belt 5*a*, and the electric charge of the secondary residual developer, that is, developer remaining on the surface of the transfer belt 5*a* after the secondary transfer, are removed by applying a predetermined bias voltage to the cleaning-charging roller 5*f*. After the removal of the electric charge therefrom, the residual toner is electrostatically transferred back onto the photoconductive drum 1 from the transfer belt 5*a*, in the primary transfer nipping portion; in other words, the surface of the transfer belt 5*a* is cleaned. After being transferred back onto the photoconductive drum 1, the secondary transfer residual toner is removed (recovered) from the photoconductive drum 1 by the cleaning blade 6 dedicated to the cleaning of the photoconductive drum 1. The recovered secondary transfer residual developer is collected in the recovered developer box 216 (FIG. 8).

(Structure of Mechanism for Mounting or Dismounting Development Cartridge)

Figure 2:
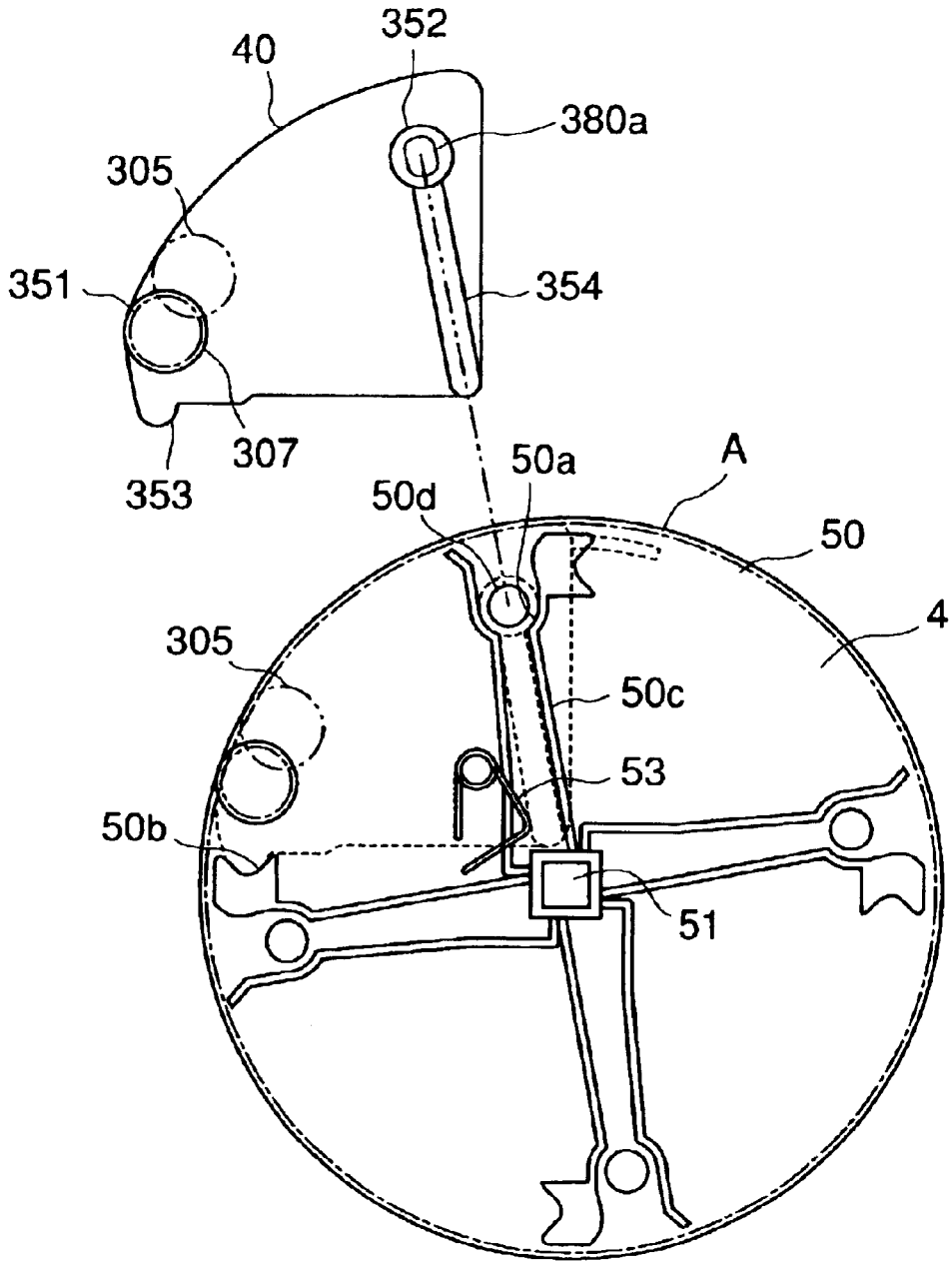
FIG. 2 is a side view of the combination of a development cartridge and a rotary device, showing how the development cartridge is mounted into the rotary device.
Figure 3:
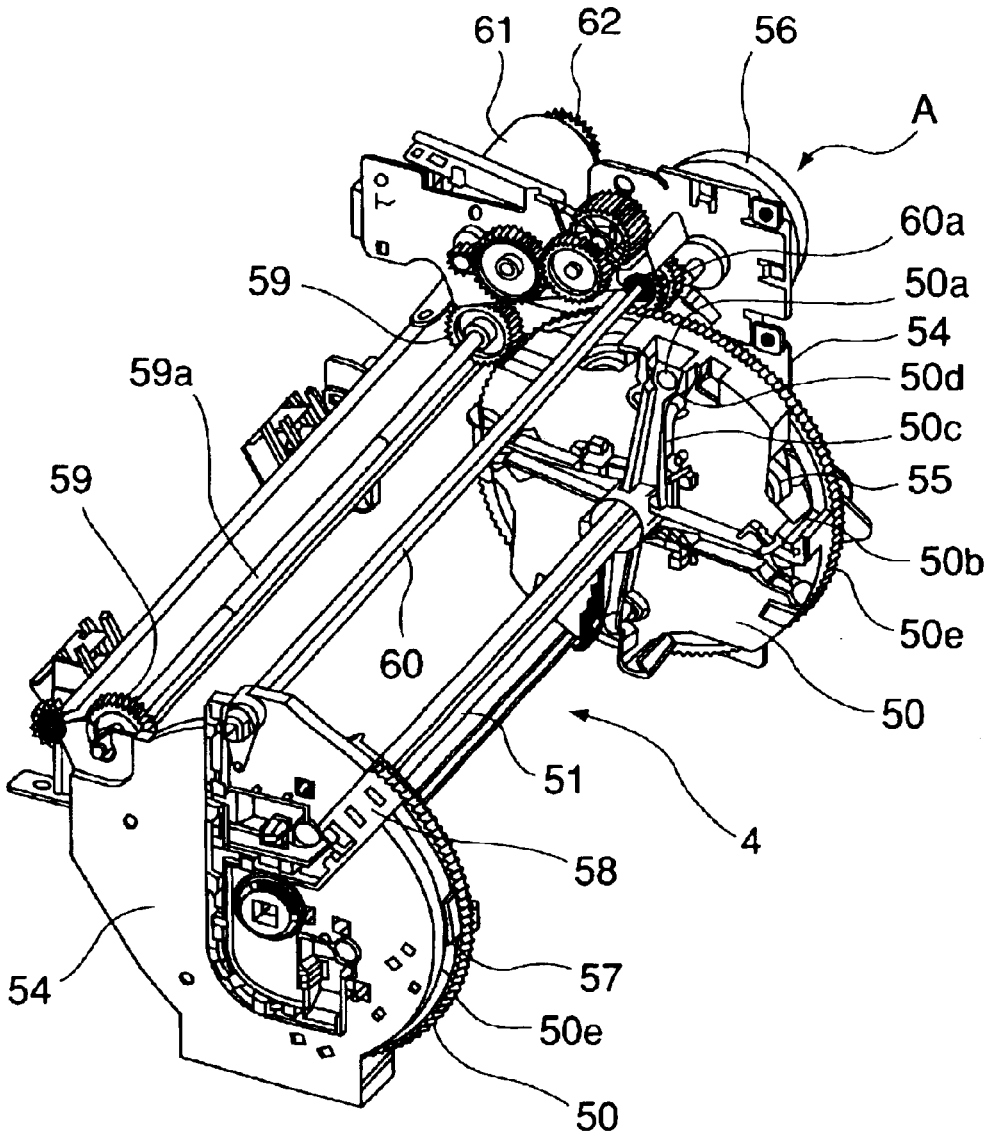
FIG. 3 is a perspective view of the rotary device.
Figure 4:
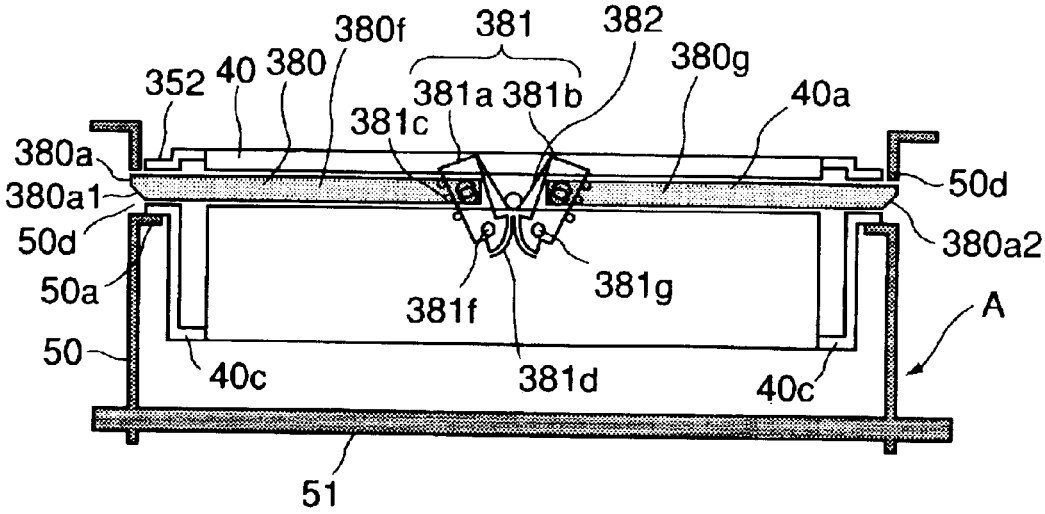
FIG. 4 is a sectional view, parallel to the front panel of an image forming apparatus, of the combination of the rotary device and the development cartridge therein, showing how the development cartridge is mounted into the rotary device.
Figure 5:
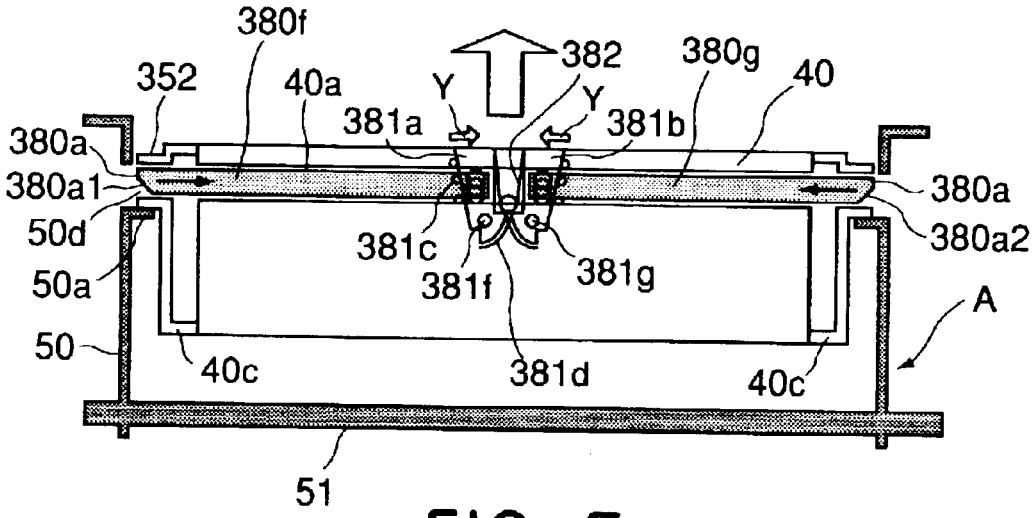
FIG. 5 is a sectional view, parallel to the front panel of the image forming apparatus, of the combination of the rotary device and the development cartridge therein, showing how the development cartridge is dismounted from the rotary device.
Figure 9:
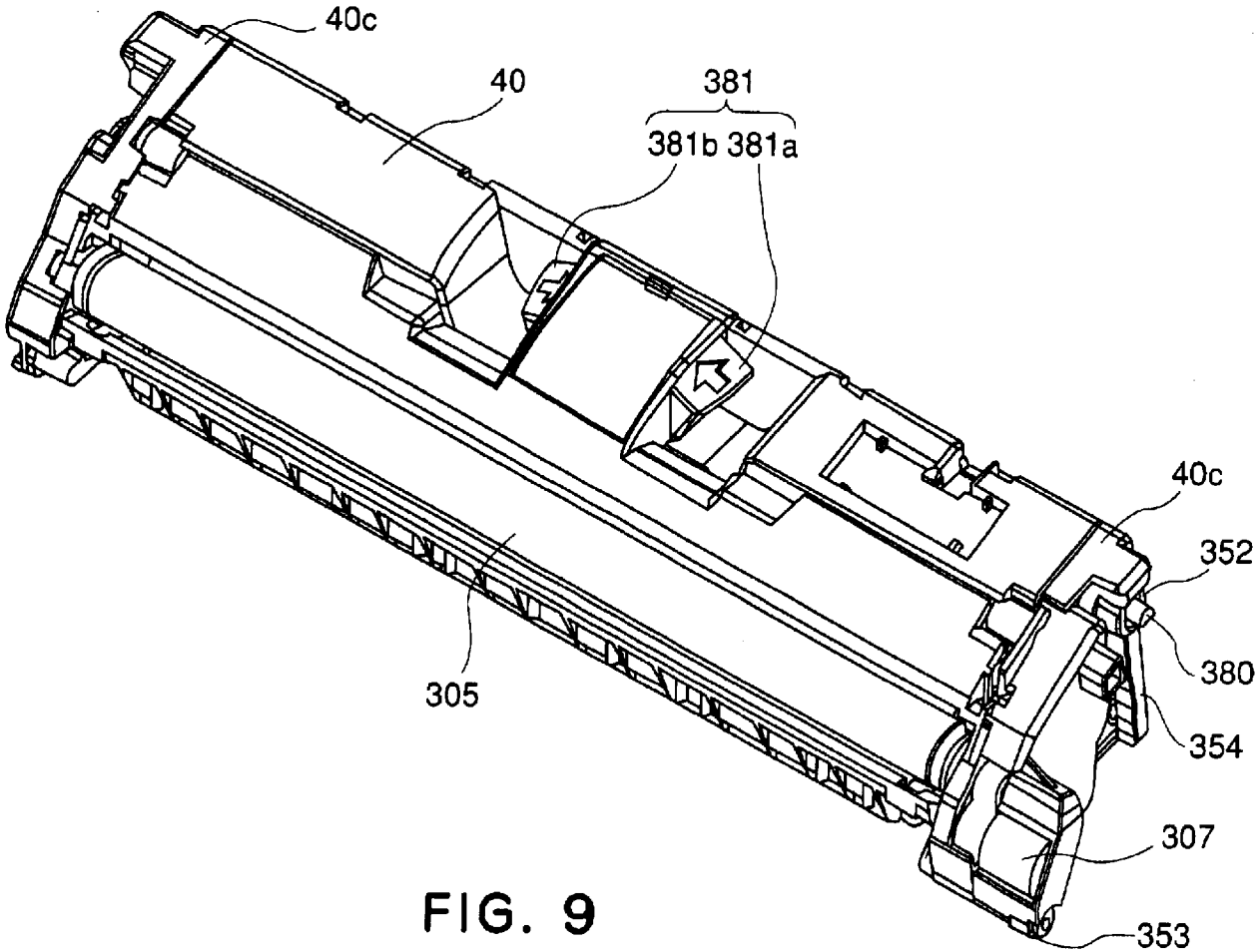
FIG. 9 is a perspective view of the development cartridge.
Figure 10:
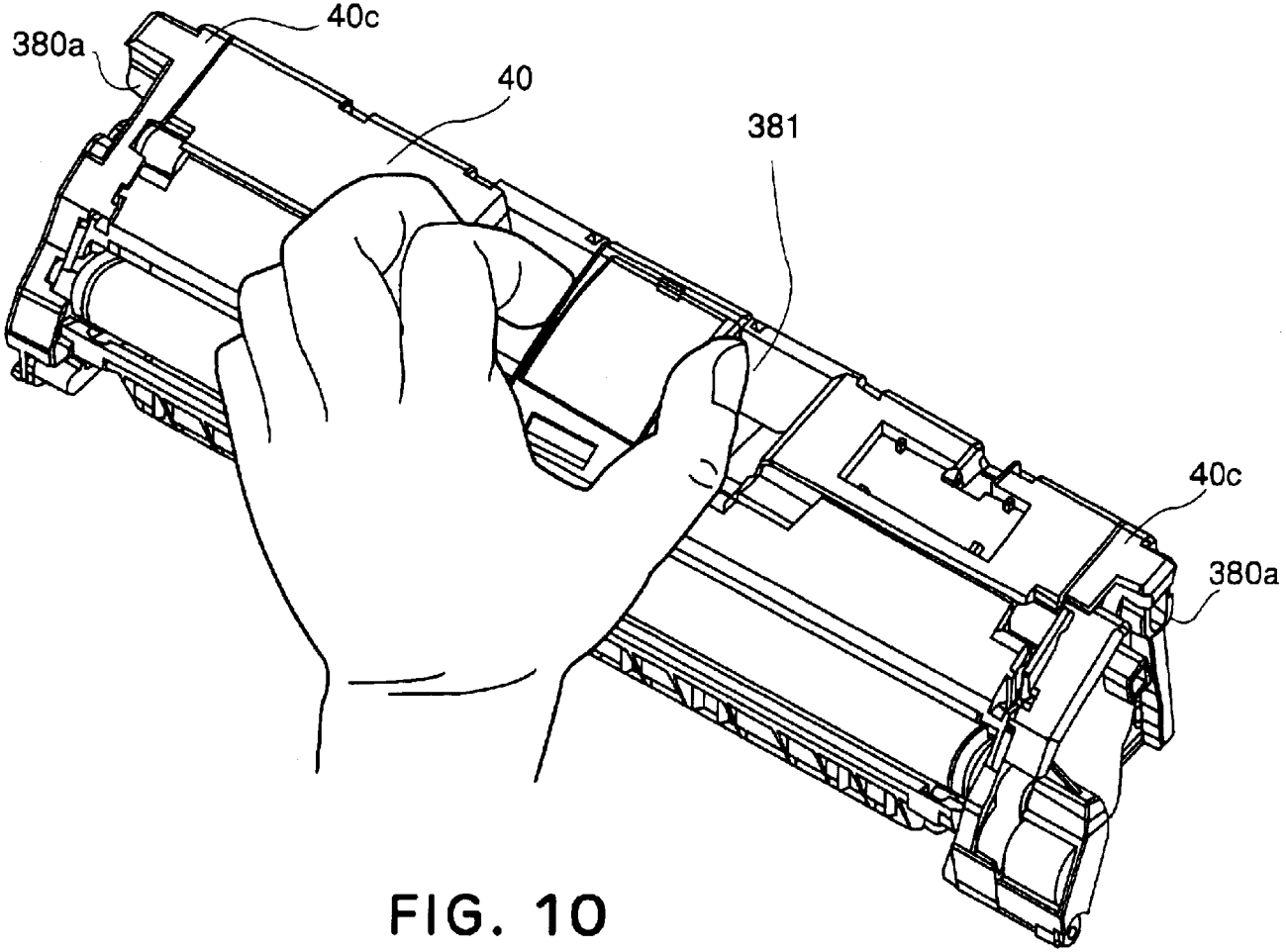
FIG. 10 is a perspective view of the development cartridge and a hand which is grasping the handle portion of the development cartridge.
Figure 11:
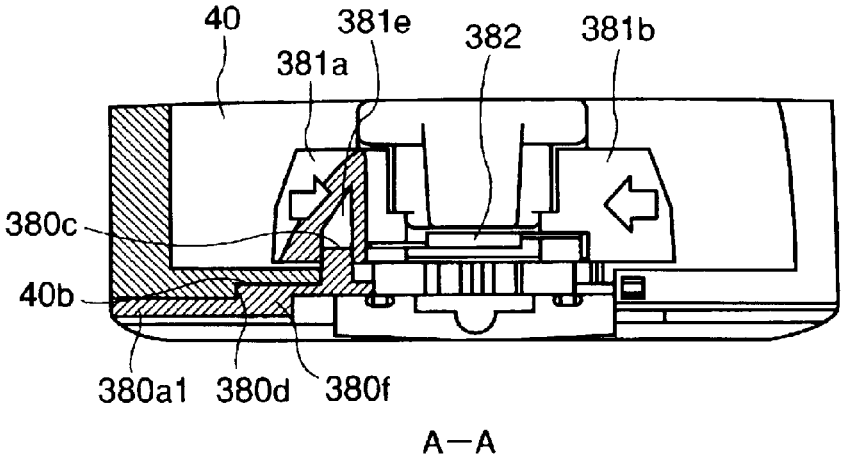
FIG. 11 is a detailed drawing of the handle portion of the development cartridge partially broken view).
Figure 12:
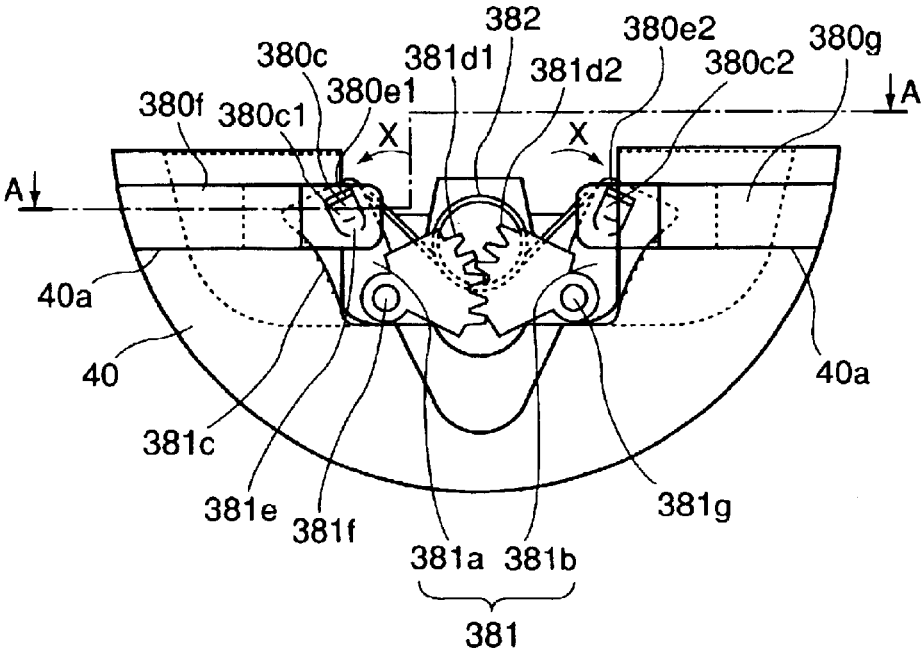
FIG. 12 is a detailed sectional view of the handle portion of the development cartridge, at a line A—A in FIG. 11.

The development cartridges 40 (40B, 40M, 40C, and 40Y) holding black, magenta, cyan, and yellow developers, one for one, are mounted in the predetermined positions, one for one, in the rotary device 4. Next, referring to FIGS. 2–5, and 9–11, the method for precisely positioning the cartridges 40 relative to the rotary device 4 will be described in detail. FIG. 2 is a side view of the combination of one of the development cartridges 40, and the rotary device 4, showing how the development cartridge 40 is mounted into the rotary device 4, and FIG. 3 is a perspective view of the rotary device 4. FIG. 4 is a sectional view, parallel to the front panel of the image forming apparatus, of the combination of one of the development cartridges 40, and the rotary device 4, showing how the development cartridge 40 is mounted into the rotary device 4, and FIG. 5 is a sectional view, parallel to the front panel of the image forming apparatus, of the combination of one of the development cartridges 40, and the rotary device 4, showing how the development cartridge 40 is dismounted from the rotary device 4. FIG. 9 is a perspective view of one of the development cartridges 40, and FIG. 10 is a perspective view of one of the development cartridges 40, and the hand of an operator, which is grasping the handle portion 381 of the cartridge 40. FIG. 1 is a detailed drawing (partially broken view) of the handle portion of the development cartridge, and FIG. 12 is a detailed sectional view of the handle portion of the development cartridge, at a line A—A in FIG. 11.

Referring to FIG. 3, the rotary device 4 is rotatable about the center shaft 51. The center shaft 51 is provided with a pair of rotary flanges 50 in the form of a disc, which are solidly attached to the lengthwise ends of the center shaft 51, one for one. Each flange 50 is provided with: a plurality of guiding grooves 50*c* for guiding the cartridge 40 when the cartridge 40 is mounted or dismounted; a plurality of first cartridge catching portions 50*a* as referential points for accurately positioning the cartridges 40; and a plurality of second cartridge catching portions 50*b* for controlling the rotation of the cartridge 40. Each cartridge catching portion 50*a* is provided with a cartridge locking hole 50*d* (which hereinafter will be simply referred to as hole 50*d*), which is in the bottom wall, that is, the wall parallel to the flange 50, of the cartridge catching portion 50*a*. The center of the hole 50*d* coincides with the center line of the cartridge catching portion 50*a*, which is parallel to the lengthwise direction of the cartridge catching portion 50*a*. The hole 50*d* constitutes the hole, into which the cartridge locking portion of the development cartridge 40 snaps to prevent the dislodgment of the development cartridge 40.

On the other hand, the cartridge 40 is provided with: a pair of guiding ribs 354 which are for guiding the cartridge 40 when the cartridge is mounted or dismounted, and which are on the outward surfaces of the lengthwise end walls of the cartridge 40, one for one; a pair of arcuate positioning portions 352 (which hereinafter will be referred to as first projection 352) which are for precisely positioning the cartridge 40 relative to the apparatus main assembly A when the cartridge 40 is mounted into the apparatus main assembly A, and which are on the outward surfaces of the lengthwise end walls of the cartridge 40, one for one; a pair of arcuate projections 353 (which hereinafter will be referred to as second projections 353) which is for preventing the cartridge 40 from rotationally moving, and which are on the outward surfaces of the lengthwise end walls of the cartridge 40, one for one. Thus, the cartridge 40 is precisely positioned relative to the apparatus main assembly A, by the coordination between the first and second projections 352 and 353.

Further, the cartridge 40 is provided with a pair of cartridge locking portions 380*a* (which hereinafter may sometimes be referred to as movable cartridge locking portions 380*a*), which can be caused to protrude from, or retracted into, the above-described pair of first projections 352, one for one, in the lengthwise direction of the cartridge 40. Actually, each cartridge locking portion 380*a* is the outward end portion of a member 380 for unlocking the cartridge from the rotary device 4 (which hereinafter will be referred to as slider 380). More specifically, referring to FIG. 4, the cartridge 40 is provided with two cartridge unlocking members 380, that is, first and second cartridge unlocking members 380*f* and 380*g* (which hereinafter will be referred to as first and second sliders 380*f* and 380*g*, respectively), the lengths of which are roughly half the length of the cartridge 40. The outward ends of the first and second sliders 380*f* and 380*g* constitute the aforementioned pair of cartridge locking portions 380*a*, more precisely, the cartridge locking portions 380*a*1 and 380*a*2, respectively.

As these sliders 380 are slid in their lengthwise directions, the cartridge locking portions 380*a* (380*a*1 and 380*a*2) protrude from, or retract into, the end surfaces of the aforementioned pair of projections 352, one for one. The cartridge 40 is also provided with a handgrip 381 (which hereinafter will be simply referred to as handle 381), which is located roughly in the center portion of the cartridge 40 in terms of the lengthwise direction of the cartridge 40. The handle 381 is kept under the pressure generated by the resiliency of a torsion coil spring 382 in the direction to keep the top ends of the two portions of the handle 381 away from each other (direction indicated by arrow mark X in FIG. 12).

Each slider 380 is in the form of a rod, and is fitted in a guiding groove 40*a* provided in the rear wall of the cartridge 40, being enabled to be slid along the guiding groove 40*a*. Further, each of the two portions of the handle 381 is a part of the cartridge unlocking member 380.

Each guiding groove 40*a* has a step 40*b*, and each slider 380 (380*f* or 380*g*) has a step 380*d*. The sliding range of the slider 380 (380*f* or 380*g*) is regulated by the steps 40*b* and step 380*d*; the contact between the two steps 40*b* and 380*d* prevents further sliding of the slider 380 (380*f* or 380*g*). In other words, the combination of the step 40*b* and step 380*d* prevents the slider 380 from sliding out of the groove 40*b* (FIG. 11). Incidentally, FIG. 11 shows only the slider 380*f*.

The handle 381 has two lever-like knobs, that is, first knob (left knob) 381*a* and second knob (right knob) 381*b*. These knobs 381*a* and 381*b* are connected to the sliders 380, one for one. Thus, as an operator carries out the cartridge unlocking or locking procedure, more specifically, grasps or release the handle 381, the sliders 380 are made to slide.

To describe in more detail, each of the lever-like knobs 381*a* and 381*b* is provided with a hole 380*e* with an elongated cross section, which is in the lateral surface of the knob 381*a* (381*b*), whereas each slider 380 is provided with a projection 380*c*, which is in the lateral surface of the lengthwise end portion of the slider 380, on the side opposite to the lengthwise end where the above-described projection 380*a* is present.

In other words, the handle 381 comprises a pair of lever-like knobs 381*a* and 381*b* rotatable about the shafts 381*f* and 381*g*, respectively. The lever-like knobs 381*a* and 381*b* are provided with gear portions 381*d*1 and 381*d*2, respectively, which are meshed with each other. Further, the lever-like knob 381*a* is provided with a hole 380*e*1 with an elongated cross section, whereas the first slider 380*f* is provided with a projection 380*c*1, which is fitted in the hole 380*e*1. Similarly, the lever-like knob 381*b* is provided with a hole 380*e*2 with an elongated cross section, whereas the first slider 380*g* is provided with a projection 380*c*2, which is fitted in the hole 380*e*2. Further, there is disposed the torsion coil spring 382 between the pair of lever-like knobs 381*a* and 381*b*, keeping thereby the lever-like knobs 381*a* and 381*b* pressured by the resiliency of this torsion coil spring 382 in the direction indicated by the arrow mark X in FIG. 12, that is, in the direction to keep the free ends (top ends) of the lever-like knobs 381*a* and 381*b* apart from each other. Thus, normally, the cartridge locking portions 380*a* (380*a* 1 and 380*a* 2), that is, the outward end portions of the sliders 380*f* and 380*g*, respectively, remain projecting from the frame 40*c* of the cartridge 40. Then, as an operator grasps the handle 381 (FIG. 10), the lever-like knobs 381*a* and 381*b* are rotated against the resiliency of the spring 382 in the direction opposite to the direction of the arrow mark X (direction indicated by arrow mark Y in FIG. 5). As a result, the cartridge locking portions 380*a* are retracted into the frame 40*c*.

Normally, the lever-like knobs 381*a* and 381*b* of the handle 381 are under the pressure from the torsion coil spring 382. Therefore, the lever-like knobs 381*a* and 381*b* remain in their open positions, keeping the cartridge locking portions 380*a* (380*a* 1 and 380*a* 2) of the sliders 380 (380*f* and 380*g*), respectively, projected from the end surfaces of the aforementioned projections 352, that is, the end surfaces of the cartridge frame 40*c*, one for one. On the contrary, as an operator grasps the handle 381, the lever-like knobs 381*a* and 381*b* move into their closed positions, retracting thereby the cartridge locking portions 380*a* (380*a* 1 and 380*a* 2) into the cartridge frame 40*c*, beyond the end surfaces of the corresponding projections 352.

The handle 381 is provided with a plurality of nonslip ribs 381*c* for preventing the cartridge 40 from slipping out of the hand of an operator who is carrying the cartridge 40 by grasping the handle 381. The nonslip ribs are 0.5 mm in height, and are on the surfaces of the lever-like knobs 381*a* and 381*b*, which come into contact with the hand of an operator. Further, each of the lever-like knobs 381*a* and 381*b* of the handle 381 is shaped so that even when it is in the closed position, the top end portion of its surface with the nonslip ribs slightly protrudes relative to the bottom end portion in terms of the lengthwise direction of the cartridge 40 (each lever-like knob portion is shaped so that its bottom portion is thinner than its top portion in terms of lengthwise direction of cartridge).

Referring to FIG. 5, the lever-like knobs 381*a* and 381*b* of the handle 381 are provided with the gear portions 381*d* 1 and 381*d* 2, respectively, which are on the opposite sides of the lever-like knobs 381*a* and 381*b* with respect to the surfaces with the nonslip ribs. The two gears 381*d* 1 and 381*d* 2 are meshed with each other. Therefore, even if the lever-like knob 381*a*, for example, is the only lever-like knob that is actually pressed into the closed position by the hand of an operator, the lever-like knob 381*b* is also moved into its closed position, and vise versa. In other words, the two sliders 380*f* and 380*g*, that is, the left and right sliders, always move together, preventing thereby the accident that only one side of the cartridge 40 is locked into, or unlocked from, the proper cartridge position in the rotary flange 50. Therefore, the cartridge 40 can be reliably mounted into, or dismounted from, the apparatus main assembly (rotary device 4).

The cartridge 40 is to be inserted into the rotary device 4 in the following manner. First, an operator is to pick up the cartridge 40 by grasping the handle 381, and align the guiding ribs 354 on the lateral surfaces of the cartridge 40 with the guiding grooves 50*c* of the flanges 50. Then, the operator is to insert the cartridge 40, with the guiding ribs 354 sliding in the guiding grooves 50*c*. Then, the operator is to release the handle 381 from his or her hand as the projections 352 on the lateral surfaces of the cartridge 40 come into contact with the first cartridge catching portions 50*a* on the lateral surfaces of the flange 50. As the handle 381 is released, the cartridge locking portions 380*a* project from the end surfaces of the projections 352, and lock into the holes 50*d* in the bottom surfaces of the cartridge catching portions 50*a* (FIG. 4).

The axial lines of the projection 352 and cartridge locking portion 380*a* coincide. Therefore, the cartridge 40 is rotationally movable about the projection 352. Further, in the guiding groove 50*c*, there is disposed a spring 53 for keeping the cartridge 40 pressured in the counterclockwise direction. Therefore, the second projection 353 (cartridge 40) is kept in contact with the cartridge catching portion 50*b* (rotary flange) by the resiliency of the spring 53. Consequently, the position of the cartridge 40 relative to the apparatus main assembly A (rotary device 4) is fixed; it is assured that the cartridge 40 is properly positioned relative to the flange 50, making it possible to always obtain an image with no irregularities.

In order to remove the cartridge 40 from the apparatus main assembly A (rotary device 4), an operator is to grasp the handle 381 as shown in FIGS. 5 and 10. As the operator grasps the handle 381, the cartridge locking portion 380*a* (380*a* 1 and 380*a* 2) is retracted, being thereby disengaged from the hole 50*d*. Then, the cartridge 40 can be removed from the apparatus main assembly A (rotary device 4).

With the provision of the above-described structural arrangement, an operator can unlock the cartridge 40 from the rotary device 4 simply by grasping the handle 381, not only improving the operability, but also eliminating the need for providing the apparatus main assembly A with springs or the like dedicated to the prevention of the dislodgment or falling out of the cartridge. Therefore, there is virtually no load to which the cartridge is subjected when it is removed from the apparatus main assembly A. Further, the structure is very simple. Therefore, there is unlikely to be mechanical trouble, and the manufacturing cost is lower.

Further, the handle 381 is located roughly in the center portion of the cartridge 40 in terms of the lengthwise direction of the cartridge 40, making it easier to carry the cartridge 40, as well as making it easier to keep the cartridge 40 better balanced, that is, more stable. Therefore, an operator can easily mount or dismount the cartridge 40 with one hand.

(Structure of Mechanism for Driving Development Cartridge) Next, referring to FIG. 6, the structure of the mechanism for driving the cartridge 40 will be described. The rotary device 4 is provided with a pair of side plates 54, each of which is on an outward side of the pair of rotary flanges 50, one for one. The flanges 50 and side plates 54 are attached to the center shaft 51 in a manner of being pierced with the center shaft 51. In other words, the flanges 50 and center shaft 51 are rotatably supported by the side plates 54. Further, the rotary device 4 has a plurality of gears, which are attached to the one of the side plates 54, being meshed with each other. The power input gear 307 of the cartridge 40 meshes with the most downstream gear 55 of these gears (gear train) attached to the side plate 54. Thus, the development roller 305, coating roller, sitting member, etc., are rotationally driven by the driving force transmitted through the power input 307 from the apparatus main assembly A.

In this embodiment, as the flanges 50 rotate a predetermined angle, the cartridge 40 is orbitally moved about the rotational axis of the flanges 50 by the same angle as the angle by which the flanges 50 rotate. As a result, the power input gear 307 meshes with the gear 55. However, there is a possibility that when the cartridge is orbitally moved by the rotation of the rotary device 4, the gear 55 and gear 307 collide with each other by the tips of their teeth and fail to properly mesh with each other. Even in such a case, the gears must be properly meshed. In this embodiment, therefore, the cartridge 40 is allowed to temporarily rotate about the axial line of the cartridge catching portion 50*a* in the direction to move the gear 307 away from the gear 55, assuring thereby that the two gears will properly mesh with each other. To elaborate further, if the gear 55 and the gear 307 collide by the tips of their teeth, the cartridge 40 is allowed to be slightly rotated about the axial line of the cartridge catching portion 50*a* by the impact from the collision. As a result, the gears 55 and 307 are temporarily disengaged, and then, they properly engage with each other as the cartridge 40 is moved back into the proper cartridge position by the resiliency of the spring 53 of the rotary device 4.

There is, however, a possibility that the gear 55 will fail to become disengaged from the gear 307, when the flanges 50 must be rotated to orbitally move the next cartridge 40 into the driving position after the driving of a given cartridge 40. Also in such a case, the above-described mechanism for allowing the cartridge 40 to slightly rotate in the radius direction of the rotary 4 assures that the gear 55 becomes disengaged from the gear 307.

Figure 6:
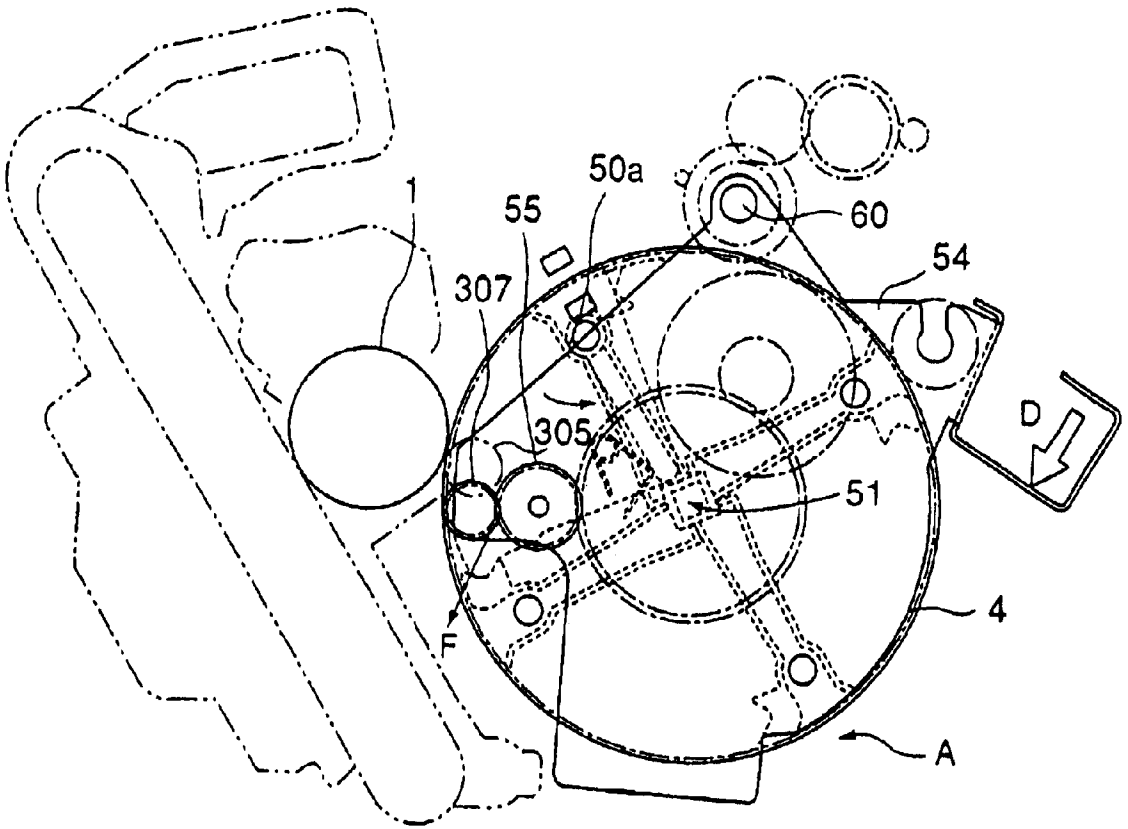
FIG. 6 is a schematic drawing showing the structure of the mechanism for driving the development cartridge.

As the gear 307 receives the driving force from the gear 55, the gear 307 is subjected to a force F, that is, the reaction to the transmission of the driving force, which acts in the direction indicated by an arrow mark in FIG. 6. In other words, this reaction F gives to the cartridge 40 such moment that rotates the cartridge 40 in the counterclockwise direction about the axial line of the cartridge catching portion 50*a*. Thus, the second projection 353 is kept pressed on the cartridge catching portion 50*b* by this moment. Therefore, the cartridge 40 is prevented from becoming dislodged from the proper cartridge position in rotary device 4. This reaction F constitutes a closed system of force within the rotary device 4. Therefore, it has little effect upon the pressure which is applied to the photoconductive drum 1 in the cartridge 40.

(Structure of Mechanism for Pressing Development Cartridge)

In this embodiment, four cartridges 40 different in color are mounted in the rotary device 4, and are kept pressed on the photoconductive drum 1 in the following manner. As described above, the flanges 50 are rotatably supported by the side plates 54, being therefore rotatable relative to the side plates 54. Further, the side plates 54 are attached, by their top end portions, to the lengthwise ends of the shaft 60 rotationally supported by the side plates of the apparatus main assembly A. In other words, the cartridge 40, flanges 50, and side plates 54 are rotatable together about the shaft 60. Thus, as the combination of the cartridge 40 and rotary device 4 is rotated about the shaft 60, the cartridge 40 is pressed upon, or moved away from, the photoconductive drum 1. This rotational movement of the combination of the cartridge 40 and rotary device 4 is caused by pushing, or releasing, a rotary stay fixed to the side plate 54, by a cam (unshown).

(Control of Rotary Rotation)

Referring to FIG. 3, The flanges 50 located at the lengthwise ends of the rotary 4, one for one are provided with a gear 50*e*, which is an integral part of the peripheral portion of the flange 50. Further, there are disposed a pair of gears 59, which mesh with the gears 50*e* and follow the rotation of the gears 50*c*. The two gears 59 are connected with a rotational shaft 59*a*. Thus, as one of the rotary flanges 50 is rotated, the other flange 50 is rotated by the rotational shaft 59*a* in the same phase as the first flange. This structural arrangement prevents the accident that one of the flanges 50 becomes twisted when the flanges 50 are orbitally moved or when the development roller is driven.

The shaft 60, about the axial line about which the side plates pivot, is provided with a rotary driving gear 60*a*, which is connected to the rotary driving motor 61. To the end of the rotational shaft of the motor 61, an encoder 62 of one of the known types is attached. The encoder 62 detects the amount of the rotation of the motor 61, and controls the rotation of the motor 61. As for the flange 50, it is provided with a flag 57, which projects sideway from the peripheral surface of the flange 50, and is positioned so that as the rotary device 4 is rotated, the flag 57 passes through the photo-interrupter 58 attached to the side plate 54.

In this embodiment, the rotation of the rotary device is controlled with reference to the point in time at which the flag 57 passes through the photo-interrupter 58, so that as the rotary device 4 is rotated a predetermined angle, the cartridges 40 are orbitally moved about the axial line of the rotary device 4 by the same angle as the predetermined angle by which the rotary device is rotated. The angle by which the rotary device 4 is rotated (cartridges 40 are orbitally moved) is controlled with reference to the amount of the rotation of the motor 61 detected by the encoder 62.

(Structure of Development Cartridge)

Figure 7:
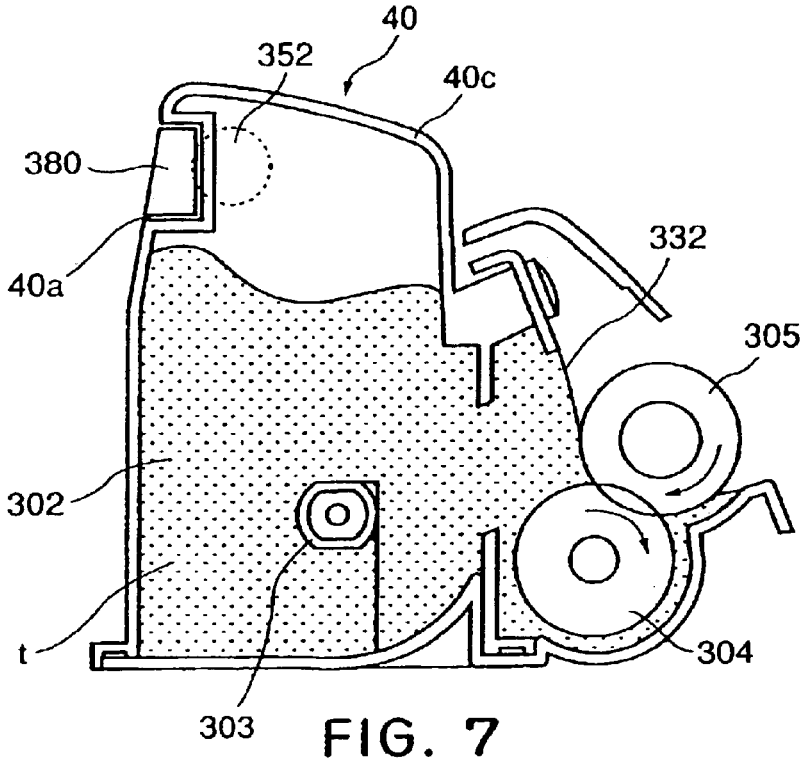
FIG. 7 is a schematic drawing showing the structure of the development cartridge.

Next, referring to FIG. 7, the structure of the development cartridge will be described.

The cartridge 40 can be roughly divided into the developer storage portion 302 and development portion. The developer storage portion 302 is filled with a developer t of a given color. The developer t is conveyed to the development portion in a predetermined amount by the rotation of a stirring unit 303. In the development portion, the developer is supplied to the peripheral surface of the development roller 305 by the rotation of a developer supplying roller 304 formed of spongy material. After being supplied to the peripheral surface of the development roller 305, the developer is formed into a thin layer by a development blade 332 while being charged by the friction against the development blade 332 and development roller 305. Then, the thin layer of the developer on the development roller 305 is moved into the development portion by the rotation of the development roller 305. In the development portion, a predetermined development bias is applied to the development roller 305, developing thereby the electrostatic latent image on the photoconductive drum 1. In other words, the development roller 305 and developer supply roller 304 are disposed in the development portion.

The residual developer, which did not contribute to the development of the latent image formed on the photoconductive drum 1, that is, the developer remaining on the peripheral surface of the development roller 305 after the development, is stripped away by the developer supplying roller 304, while the developer supplying roller 304 supplies the peripheral surface of the development roller 305 with a fresh supply of the developer to continue the ongoing development operation.

(Structure of Process Cartridge)

In this embodiment, the above-described photoconductive drum 1, intermediary transfer belt 5*a*, and removed developer box 216 are integrally disposed in a cartridge removably mountable in the main assembly of an image forming apparatus; they are unitized in the form of a process cartridge 5. FIG. 8 is a perspective view of the process cartridge 5 as seen from the left side. The process cartridge 5 can be roughly divided into two units, that is, a photoconductive drum unit 20 which holds the photoconductive drum 1, and an intermediary transfer unit 21 which has the above-described intermediary transfer belt 5*a* and removed developer box. As for the positional relationship between the units 20 and 21, they are positioned so that when the process cartridge is positioned as shown in FIG. 8, the unit 20 will be roughly above the unit 21. The left and right plates 260 and 261 are extended so that they can be used to support the unit 20 by the lengthwise ends of the unit 20.

(Embodiment 2)

Figure 13:
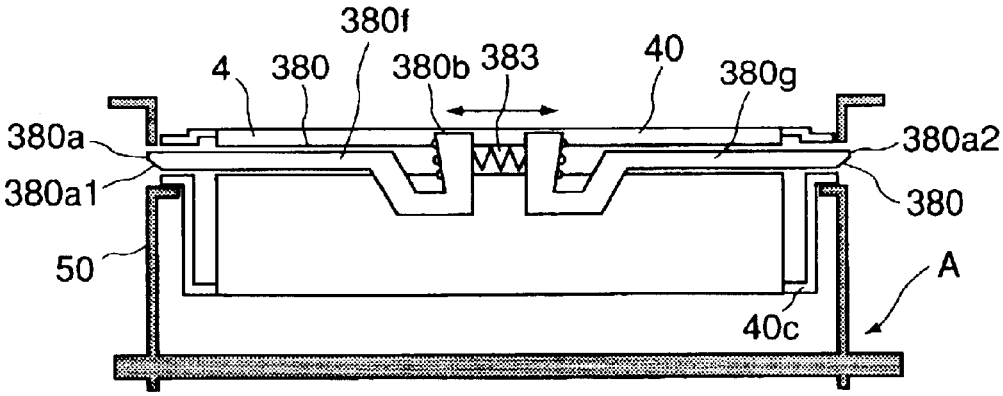
FIG. 13 is a sectional view, parallel to the front panel of an image forming apparatus, of the combination of the rotary device and the development cartridge therein, in the second embodiment of the present invention, showing how the development cartridge is mounted into the rotary device.

Next, referring to FIG. 13, the second embodiment of the combination of a development cartridge and an image forming apparatus, in accordance with the present invention, will be described. FIG. 13 is a schematic sectional view, parallel to the front panel of the image forming apparatus, of the combination of a rotary device 4 and a development cartridge 40 therein, in this embodiment, showing how the development cartridge 40 is mounted into the rotary device 4. The components, portions, etc., in this embodiment, which are identical to those in the first embodiment, will be given the same referential characters as the referential characters given to those in the first embodiment, and will not be described here.

In the first embodiment of the present invention, the handle 381 is connected to the sliders 380. The present invention, however, does not need to be limited to the first one. For example, the sliders may be an integral part of the handle, as shown in FIG. 13.

As shown in the drawing, each slider 380 is provided with a knob-like portion 380*b*. Further, there is disposed a compression spring 383 between the left and right sliders 380, so that the two sliders 380 are kept pressured outward of the cartridge 40 in terms of the lengthwise direction. Thus, normally, the cartridge locking portions 380*a* 1 and 380*a* 2, that is, the lengthwise end portions of the sliders 380*f* and 380*g* remain protruding from the lengthwise ends of the cartridge 40. However, as an operator grasps the handle 381 in a manner to squeeze the two knob-like portions 380*b* toward each other, the cartridge locking portions 380*a* 1 and 380*a* 2 are retracted into the cartridge frame 40*c*, allowing the cartridge 40 to be mounted into, or removed from, the apparatus main assembly 100*a*.

The apparent relationship between the cartridge 40 and flanges 50 is the same as that in the first embodiment. However, this embodiment is smaller in component count, and therefore is lower in development cartridge production cost.

(Embodiment 3)

Figure 14:
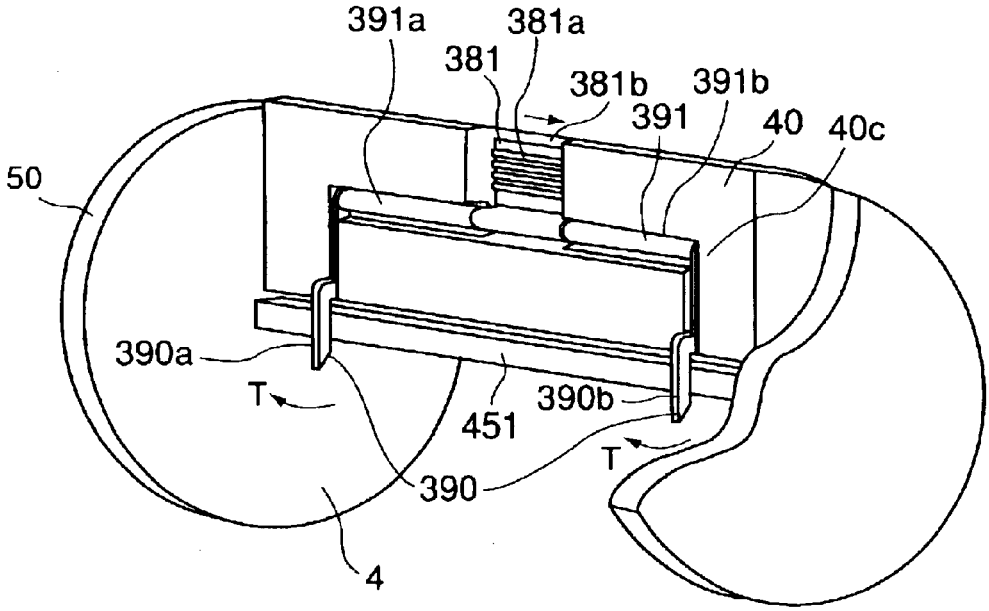
FIG. 14 is a perspective view of the combination of the rotary device and the development cartridge therein, in the third embodiment of the present invention.
Figure 15:
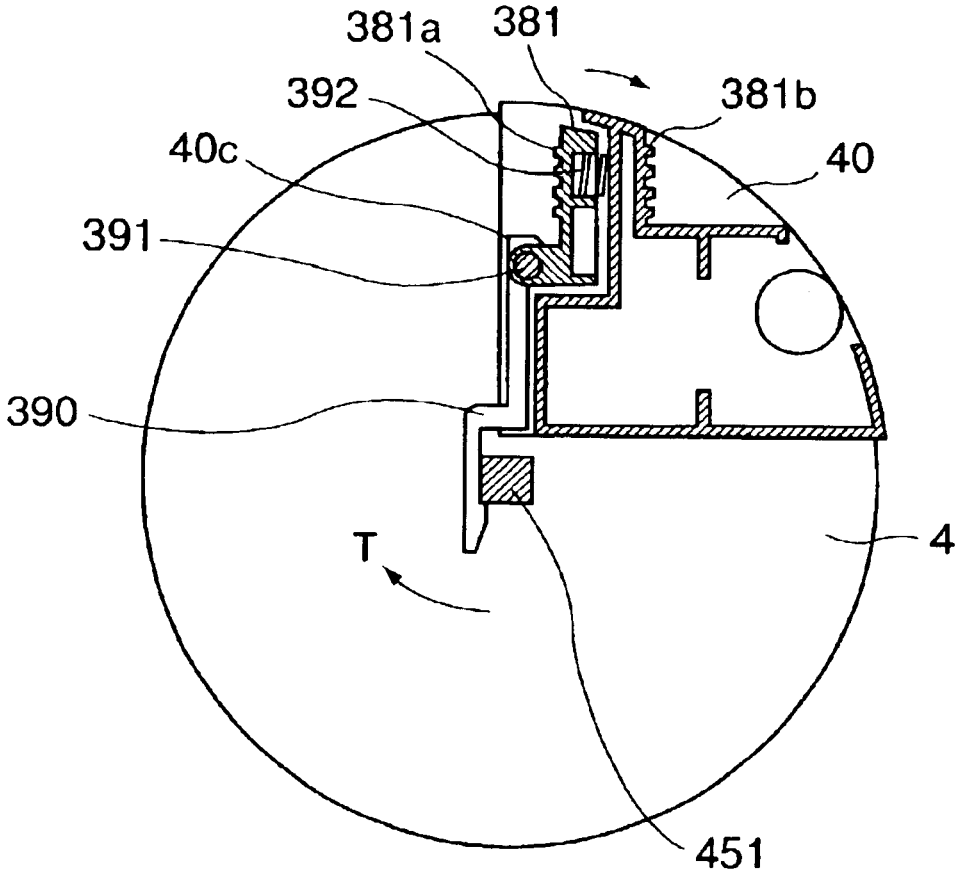
FIG. 15 is an enlarged sectional view of the portion of FIG. 14 concerning the present invention.

Next, referring to FIGS. 14 and 15, the third embodiment of the present invention will be described. FIG. 14 is a perspective view of the combination of the rotary device 4 and development cartridge 40 therein, in this embodiment, as seen from the back side of the apparatus, showing how the development cartridge 40 is mounted into the rotary device 4, and FIG. 15 is a schematic sectional view of the development cartridge 40 in this embodiment. The components, portions, etc., in this embodiment, which are identical to those in the first embodiment, will be given the same reference characters as the reference characters given to those in the first embodiment, and will not be described here.

In the first and second embodiments, the development cartridge 40 and rotary device 4 are structured so that the cartridge locking portions 380*a* 1 and 380*a* 2 projecting from the lengthwise ends of the development cartridge 40 lock into the holes of the rotary device 4, one for one, to prevent the development cartridge 40 from dislodging. These embodiments are not intended to limit the scope of the present invention. For example, the development cartridge 40 may be provided with a pair of hooks 390 which latch onto the center shaft 451 of the rotary device 4. More specifically, in such a structural arrangement, the handle 381 is connected to a rotational shaft 391 which extends in the lengthwise direction of the cartridge 40, and the rotational shaft 391 is provided with the pair of hooks 390 which perpendicularly extend from the lengthwise ends of the rotational shaft 391, one for one. Further, the rotational shaft 391 is rotatably attached to the cartridge frame 40*c*, and the handle 381 is kept pressured by the resiliency of the compression spring 392 in the direction to widen the distance between the top portion of the knob-like portion 38 la of the handle 381 from the knob-like portion 381 b of the handle 381. Therefore, normally, the hooks 390 remain pressured in the direction to cause them to latch on the center shaft 451. With the provision of the above-described structural arrangement, as the handle is grasped, the hooks 390 at the lengthwise ends of the cartridge 40 are caused to rotate in the direction indicated by an arrow mark T in FIG. 15, being thereby unlatched from the center shaft 451. Consequently, it becomes possible for the cartridge 40 to be removed from the apparatus main assembly A.

In other words, in the case of this embodiment, the hooks 390 (first and second hook portions 390*a* and 390*b*) constitute the cartridge locking portions, and the shaft 451 constitutes the cartridge locking portion on the apparatus main assembly side. Further, the rotational shafts 391 (first and second rotational shafts 391*a* and 391*b*) constitute the cartridge unlocking members.

The above-described embodiments of the present invention can be summarized as follows:

The cartridge 40 removably mountable in the main assembly (A) of an electrophotographic image forming apparatus, includes: the developing member 305 for developing the electrostatic latent image formed on the photoconductive drum (1); developer storage portion (302) for holding the developer t used by the developing member 305 for developing the above-described electrostatic latent image; the cartridge locking portions (380*a* (FIGS. 4, 5, and 9), or 390 (FIGS. 14 and 15)) which engage with the cartridge locking portions (50*d* (FIG. 2 and 4), or 451 (FIG. 14)) of the apparatus main assembly (A), in order to lock the cartridge 40 in position; cartridge unlocking members (380, 381 (FIGS. 4, 5, and 9), or 391 (FIGS. 14 and 15)) to be used for disengaging the cartridge locking portions (380*a*, 390) from the cartridge locking portions (50*d*, 451) when removing the cartridge 40 from the apparatus main assembly (A); etc.

The cartridge unlocking member is provided with the handle (381) to be grasped when mounting the cartridge (40) in the apparatus main assembly (A) or removing the cartridge (40) from the apparatus main assembly (A).

The handle (381) is rotatable about the shafts 381*f* and 381*g*. Thus, as the handle 381 is grasped, the lever-like knob portions thereof are rotated about the shafts 381 f and 381*g*, sliding the cartridge unlocking members 380. As a result, the cartridge locking portions (380*a* 1 and 380*a* 2), which are the lengthwise outward ends of the cartridge unlocking members 380 are disengaged from the cartridge locking portions (50*d*) of the apparatus main assembly.

Further, the cartridge locking members (380*a* (380*a* 1 and 380*a* 2)) are the lengthwise outward ends of the cartridge unlocking members (380 (380*f*, 380*g*). Therefore, they are caused to project from, retract into, the frame 40*c* of the cartridge 40 by the movement of the cartridge unlocking member (380 (380*f* and 380*g*)).

The cartridge locking portions (380*a* (380*a* 1 and 380*a* 2)) project from, or retract into, the portions of the cartridge frame 40*c*, which are the lengthwise ends of the cartridge frame 40*c*, and which are located opposite to the lengthwise ends of the developing member (305).

The cartridge locking portion (380*a* (380*a* 1 and 380*a* 2)) are disposed roughly in the center of the cartridge positioning portion (352) for precisely positioning the cartridge 40 relative to the apparatus main assembly A as the cartridge (40) is mounted into the apparatus main assembly (A).

The handle (381) includes: the first and second lever-like portions (381*a* and 381*b*, respectively) which rotate about the first and second shafts (381*f* and 381*g*, respectively); first and second gear portions (381*d*1 and 38 1*d* 2, respectively) attached to the first and second lever-like portions (381*a* and 381*b*, respectively) and meshed with each other; the elastic member (torsion coil spring 382) disposed between the first and second lever-like portions (381*a* and 381*b*, respectively) so that the resiliency of the torsion coil spring works in the direction to increase the distance between the top portions of the first and second lever-like portions (381*a* and 381*b*, respectively).

The cartridge unlocking member (380) has the first and second cartridge unlocking portions (380*f* and 380*g*). Further, the cartridge locking portion (380*a*) is provided with the first cartridge locking portion (380*a* l) and second cartridge locking portion (380*a* 2). The lengthwise outward end of the first cartridge unlocking portion (380*f*) constitutes the first cartridge locking portion (380*a* l), and the other lengthwise end is connected to the first lever-like portion (381*a*). Thus, the first cartridge unlocking portion (380*f*) is moved by the movement of the first lever-like portion (381 a), causing thereby the first cartridge locking portion (380*a* l) to project from, or retract into, the cartridge frame 40*c*. Further, the lengthwise outward end of the second cartridge unlocking portion (380*g*) constitutes the second cartridge locking portion (380*a* 2), and the other lengthwise end is connected to the second lever-like portion (381*b*). Thus, the second cartridge unlocking portion (380*g*) is moved by the movement of the second lever-like portion (381*b*), causing thereby the second cartridge locking portion (380*a* 2) to project from, or retract into, the cartridge frame 40*c*. The first cartridge unlocking portion (380*f*) is disposed on one side of the handle (381) in terms of the lengthwise direction of the frame (40*c*), whereas the second cartridge unlocking portion (380*g*) is disposed on the other side.

The handle (381) and cartridge unlocking member (380) are disposed immediately outside the cartridge frame (40*c*), at the location opposite to the developer storage portion (302).

There are four types of development cartridges: black development cartridge (40B) holding black developer in its developer storage portion 302; yellow development cartridge (40Y) holding yellow developer in its developer storage portion 302; magenta development cartridge (40M) holding magenta developer in its developer storage portion 302; and cyan development cartridge (40C) holding cyan developer in its developer storage portion 302. The development cartridge 40 is removably mounted into the rotary device 4, as a part of the apparatus main assembly A, which is rotated while holding the black development cartridge 40B, yellow development cartridge 40Y, magenta development cartridge 40M, and cyan development cartridge 40C. The cartridge locking portions (380*a* or 390) disengageably engage with the cartridge locking portions (50*d* or 451) of the rotary device 4.

The above-described cartridge 40 is a process cartridge including the electrophotographic photoconductive member 1.

Incidentally, the preceding embodiments of the present invention were described with reference to a development cartridge as one example of a cartridge. However, these embodiments are not intended to limit the scope of the present invention. For example, the present invention is also compatible with a process cartridge and the like. Further, the application of the present invention is not limited to a development cartridge such as those in the preceding embodiments, that is, a cartridge in which a developing member, and a developer storage portion in which the developer used by the developing member to develop an electrostatic latent image, are integrally disposed, that is, being unitized, and which is removably mountable in the main assembly of an image forming apparatus. For example, the present invention is compatible to a development cartridge which does not comprise the developer storage portion, and also, a development cartridge which comprises other members in addition to the above-described members. Further, a process cartridge denotes a cartridge in which an electrophotographic photoconductive member, and the above-described developing member, are integrally disposed, and which is removably mountable in the main assembly of an image forming apparatus, as well as a process cartridge in which a minimum of a charging member or a cleaning member is integrally disposed in addition to the electrophotographic photoconductive member and developing member, and which is removably mountable in the main assembly of an image forming apparatus.

As described above, the present invention makes it possible to prevent a cartridge from accidentally dislodging from the main assembly of an image forming apparatus.

While the invention has been described with reference to the structures disclosed herein, it is not confined to the details set forth, and this application is intended to cover such modifications or changes as may come within the purposes of the improvements or the scope of the following claims.

What is claimed is:

1. A cartridge detachably mountable to a main assembly of an electrophotografic image forming apparatus, said cartridge comprising:

a frame;

a developing member configured and positioned to develop an electrostatic latent image formed on an electrophotographic photosensitive member;

a developer accommodating portion configured to accommodate a developer to be used for developing the electrostatic latent image by said developing member;

a cartridge locking portion configured and positioned to lock said cartridge with a main assembly locking portion provided in the main assembly of the apparatus to prevent said cartrige from disengaging from the main assembly of the apparatus when said cartridge is mounted to the main assembly of the apparatus, wherein said cartridge locking portion projects out of or is retracted into each one of and the other end portions of said frame in the longitudinal direction of said developing member; and a releasing member configured and positioned to release said cartridge locking portion to release said cartridge from the main assembly locking portion when said cartridge is to be removed from the main assembly of the apparatus.

2. A cartridge according to claim 1, wherein said releasing member has a grip portion configured and positioned to facilitate mounting and demounting of said cartridge relative to the main assembly of the apparatus, and wherein said releasing member releases said cartridge locking portion from the main assembly locking portion in response to gripping of said grip portion.

3. A cartridge according to claim 2, wherein said cartridge locking portion is provided at a free end portion of said releasing member, and wherein said grip portion is rotatable about an axis, and when said grip portion is gripped, said grip portion rotates about the axis, by which said releasing member is slid to release said cartridge locking portion from the main assembly locking portion.

4. A cartridge according to claim 1 or 2 wherein said cartridge locking portion is provided at a free end portion of said releasing member, and wherein said cartridge locking portion is projected out of said frame and is retracted into said frame in interrelation with movement of said releasing member.

5. A cartridge according to claim 1 or 2, wherein said cartridge locking portion is disposed substantially at a center of a positioning portion configured and positioned to position said cartridge relative to the main assembly of the apparatus when said cartridge is mounted to the main assembly of the apparatus.

6. A cartridge according to claim 1, wherein said releasing member has a grip portion configured and positioned to facilitate mounting and demounting of said cartridge relative to the main assembly of the apparatus, and wherein said releasing member releases said cartridge locking portion from the main assembly locking portion in response to gripping of said grip portion, wherein said cartridge locking portion is disposed substantially at a center of a positioning portion configured and positioned to position said cartridge relative to the main assembly of the apparatus when said cartridge is mounted to the main assembly of the apparatus, wherein said grip portion includes:

a first grip portion rotatable about a first axis;

a second grip portion rotatable about a second axis;

a first gear portion provided on said first grip portion;

a second gear portion provided on said second grip portion and engageable with said first gear portion; and an elastic member, disposed between said first grip portion and said second grip portion, configured and positioned to urge said first grip portion and said second grip portion away from each other.

7. A cartridge according to claim 6, wherein said releasing member includes:

a first releasing portion; and a second releasing portion, wherein said cartridge locking portion includes:

a first cartridge locking portion; and a second cartridge locking portion, wherein said first releasing portion has said first cartridge locking portion at one end thereof and is engaged with said first grip portion at the other end thereof, so that said first releasing portion is interrelated with said first grip portion to project said first cartridge locking portion out of said frame and to retract said first cartridge locking portion into said frame, wherein said second releasing portion has said second cartridge locking portion at one end thereof and is engaged with said second grip portion at the other end thereof, so that said second releasing portion is interrelated with said second grip portion to project said second cartridge locking portion out of said frame and to retract said second cartridge locking portion into said frame, and wherein said first releasing portion is disposed on said frame at one longitudinal end side of said grip portion and said second releasing portion is disposed on said frame at the other longitudinal end side of said grip portion.

8. A cartridge according to claim 7, wherein said grip portion and said releasing member are disposed outside said frame opposed to said developer accommodating portion.

9. A cartridge according to claim 1, wherein said cartridge is a black developing cartridge accommodating a black developer in said developer accommodating portion, a yellow developing cartridge accommodating a yellow developer in said developer accommodating portion, a magenta developing cartridge accommodating a magenta developer in said developer accommodating portion, or a cyan developing cartridge accommodating a cyan developer in said developer accommodating portion, which is mountable to a rotary member capable of detachably carrying said black developing cartridge, said yellow developing cartridge, said magenta developing cartridge or said cyan developing cartridge, and wherein the main assembly locking portion is provided in the rotary member.

10. A cartridge according to claim 9, wherein said cartridge is a process cartridge having the electrophotographic photosensitive member.

11. An electrophotographic image forming apparatus for forming an image on a recording material, said apparatus having a main assembly to which a cartridge is detachably mountable, said apparatus comprising:

(i) a main assembly locking portion;

(ii) a mounting portion configured and positioned to detachably mount the cartridge, the cartridge including:

a frame;

a developing member configured and positioned to develop an electrostatic latent image formed on an electrophotographic photosensitive member;

a developer accommodating portion configured and positioned to accommodate a developer to be used for developing an electrostatic latent image by the developing member;

a cartridge locking portion configured and positioned to lock the cartridge with said main assembly locking portion provided in the main assembly of said apparatus to prevent the cartridge from disengaging from the main assembly of said apparatus when the cartridge is mounted to the main assembly of said apparatus, wherein the cartridge locking portion projects out of or is retracted into each one of and the other end portions of the frame in the longitudinal direction of the developing member; and a releasing member configured and positioned to release the cartridge locking portion to release the cartridge from said main assembly locking portion when the cartridge is to be removed from the main assembly of said apparatus; and (iii) feeding means for feeding the recording material.

12. A apparatus according to claim 11, wherein said mounting portion is provided in a rotary member and includes;

a first mounting potion configured and positioned to mount a black diveloping cartridge accommodating a black developer;

a second mounting portion configured and positioned to mount a yellow developing cartridge accommododating a yellow developer;

a third mounting portion configured and positioned to mount a magenta developing cartridge accommodating magenta developer; and a fourth mounting portion configured and positioned to mount a cyan developing cartridge accommodating a cyan developer, wherein said rotary member rotates to sequentially bring the developing cartridges to a developing position where the developing cartridges face the electrophotographic photosensitive member, and wherein said rotary member is provided with said main assembly locking portion.

* * * * *

UNITED STATES PATENT AND TRADEMARK OFFICE

CERTIFICATE OF CORRECTION

PATENT NO. : 6,947,687 B2 
APPLICATION NO. : 10/453811
DATED : September 20, 2005
INVENTOR(S) : Koji Yamaguchi et al.

It is certified that error appears in the above-identified patent and that said Letters Patent is hereby corrected as shown below:

ON THE TITLE PAGE
(Item 56), References Cited, FOREIGN PATENT DOCUMENTS, "07295381" should read --7-295381--; "09329964" should read --9-329964--; and "2001175077" should read --2001-175077--.

COLUMN 7
Line 30, "is" should read --are--.

COLUMN 8
Line 19, "in" should read --the above arrangement in--.

COLUMN 9
Line 23, "vise" should read --vice--.

COLUMN 10
Line 18, "Next," should read --(New Paragraph) Next, --.
Line 31, "sitting" should read --stirring--.
Line 34, "a" should read --through a--.

COLUMN 11
Line 34, "The" should read --the--.
Line 35, "rotary" should read --rotary device--.
Line 39, "gears 50c." should read --gears 50e.--
Line 46, "about the axial line about which" should read --about whose axial line--.
Line 53, "sideway" should read --sideways--.

COLUMN 13
Line 55, "38 la" should read --381a--.
Line 59, "With" should read --(New Paragraph) With --.

COLUMN 14
Line 38, "380g)." should read --380g)).--.
Line 39, "retract" should read --or retract--.
Line 55, "38 1d 2" should read --381d2--.

UNITED STATES PATENT AND TRADEMARK OFFICE

CERTIFICATE OF CORRECTION

PATENT NO. : 6,947,687 B2
APPLICATION NO. : 10/453811
DATED : September 20, 2005
INVENTOR(S) : Koji Yamaguchi et al.

It is certified that error appears in the above-identified patent and that said Letters Patent is hereby corrected as shown below:

COLUMN 16
Line 28, "cartrige" should read --cartridge--.

Signed and Sealed this

Eighteenth Day of July, 2006

JON W. DUDAS
*Director of the United States Patent and Trademark Office*